United States Patent [19]

Kunitake

[11] 4,345,533

[45] Aug. 24, 1982

[54] SEMI-SUBMERGED SHIP

[75] Inventor: Yoshikuni Kunitake, Nagareyama, Japan

[73] Assignee: Mitsui Engineering and Shipbuilding Co. Ltd., Tokyo, Japan

[21] Appl. No.: 99,934

[22] Filed: Dec. 3, 1979

[30] Foreign Application Priority Data

Feb. 20, 1979 [JP] Japan ..... 54-19560

[51] Int. Cl.[3] ..... B63B 1/10; B63B 1/32

[52] U.S. Cl. ..... 114/61; 114/56; 114/283

[58] Field of Search ..... 114/39, 56, 61, 291, 114/283

[56] References Cited

U.S. PATENT DOCUMENTS

| | | | |
|---|---|---|---|
| 3,447,502 | 6/1969 | Leopold | 114/61 |
| 3,481,296 | 12/1969 | Stephens | 114/61 |
| 3,830,178 | 8/1974 | Lang | 114/61 |
| 4,165,701 | 8/1979 | Kluytmans | 114/61 |
| 4,174,671 | 11/1979 | Seidl | 114/61 |

*Primary Examiner*—Richard A. Bertsch
*Attorney, Agent, or Firm*—Armstrong, Nikaido, Marmelstein & Kubovcik

[57] ABSTRACT

Disclosed is a semi-submerged ship comprising at least two lower hulls always located below the surface of water and arranged substantially in parallel to each other with respect to the direction of advance, struts mounted substantially vertically on the upper portion of each of all or at least two of the lower hulls along almost the entire length thereof and an upper hull supported by these struts and always located above the surface of water. In this semi-submerged ship, at least one opening is formed on each strut wherein the height of the opening is less than the height of the strut and a water-tight seal is formed between this opening and the interior of the strut. This ship is arranged so that the draft line of the ship is located on the openings of the struts while the ship is stopped. This semi-submerged ship is effectively used as a passenger ship, a cargo ship, a floating factory ship or the like and is especially suitable for stevedoring while stopping the ship in the wavy sea.

17 Claims, 32 Drawing Figures

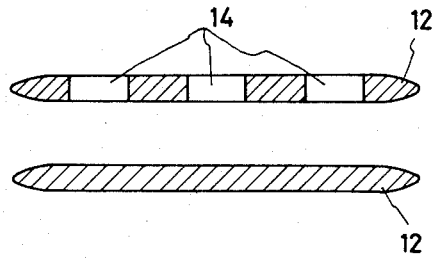
Fig.5(A)
Fig.5(B)
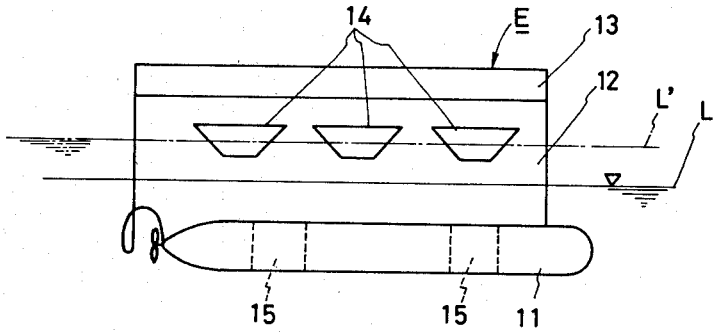
Fig.6(A)
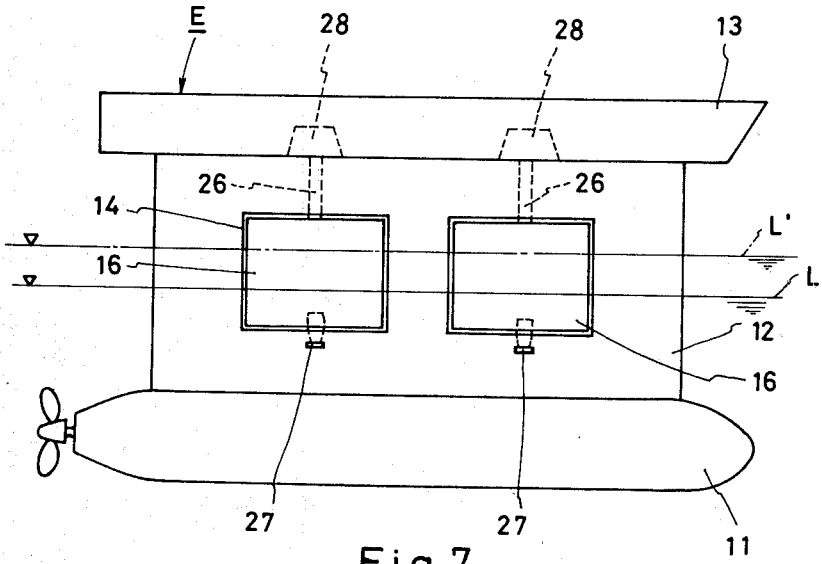
Fig.7

SEMI-SUBMERGED SHIP

BACKGROUND OF THE INVENTION

1. Field of the Invention

The present invention relates to an improvement in the semi-submerged ship. More particularly, the invention relates to an improved semi-submerged ship in which oscillations of the ship are remarkably eliminated while the ship is stopped.

2. Description of the Prior Art

As the semi-submerged ship recently attracting attentions in the art, for example, the semi-submerged catamaran, there is known a semi-submerged ship comprising an upper hull which is located above the surface of water and is used for passengers or cargos or as a floating factory and two lower hulls which are located below the surface of water and cover the majority of the displacement, wherein the upper hull is connected to the lower hulls through two struts arranged vertically across the water surface, which cover the minority of the displacement.

The structure of a typical instance of this conventional semi-submerged ship is illustrated in FIGS. 1 and 2. In this structure, two lower hulls 1 always located below the surface of water are arranged substantially in parallel to each other with respect to the direction of advance, and an upper hull 3 always located above the surface of water is connected to the lower hulls 1 through at least one relatively thin streamlined strut 2 mounted vertically on each of the lower hulls 1. In this semi-submerged ship, either the full load draft or the light load draft (unload draft) line L is on the struts.

Since the water-line area of this semi-submerged ship is smaller than that of an ordinary ship, the wave-making resistance is low and a required power at a high speed navigation is reduced. Namely, the semi-submerged ship is excellent in the high speed performance. Moreover, the semi-submerged ship is excellent in the motion characteristics on waves and the deck area can be broadened. Therefore, the loading efficiency and operation efficiency can be improved.

For example, the oscillation, one of the motion characteristics in waves will now be discussed.

The natural period Tm of the heaving motion of the ship is theoretically determined by the following equation:

$$Tm = 2\pi\sqrt{\frac{V}{gAw}}$$

wherein Tm stands for the natural period of the heaving motion of the ship, V stands for the displacement volume ($m^3$), Aw stands for the waterplane area ($m^2$) (the sectional area of the ship on the plane of the draft line), $\pi$ stands for the ratio of the circumference of a circle to its diameter and g stands for the acceleration of gravity.

As is seen from the foregoing equation, the natural period of the heaving motion of the ship is determined based on the waterplane area of the ship, and if the displacement volume is the same, the smaller is the waterplane area, the longer is the natural period of the ship motion and the less in agreement with the frequency of waves is the natural period of the ship. In other words, if the waterplane area is small, the heaving motion of the ship is reduced.

As pointed out hereinbefore, the draft line of the semi-submerged ship is on the struts 2. Accordingly, the waterplane area on the struts, that is, the sectional area of the draft line portion, is smaller than in an ordinary ship (as compared based on the same displacement volume), and the natural period is longer. Therefore, the natural period of the semi-submerged ship is hardly synchronous with the frequency of waves in an ordinary sea climate and hence, the pitching motion is reduced and a good stability is attained.

In view of the foregoing relation between the waterplane area and the natural period of motion, there has been proposed a structure in which the strut 2 is divided into front and rear parts, as shown in FIG. 3, to reduce the waterplane area. In this structure, however, the wavemaking resistance is remarkably increased by interference of the front and rear struts during navigation. Moreover, since the entire length of the strut 2 is shortened, it is difficult to ensure a required displacement. Accordingly, this structure is not preferred from the practical viewpoint.

Furthermore, since a semi-submerged ship having the above-mentioned structure has a peculiar shape quite different from the shape of an ordinary ship, designing is complicated and difficult. In order to utilize or manifest excellent technical characteristics of a semi-submerged ship sufficiently, the configurations and dimensions of the lower hulls or struts should be appropriately set. Furthermore, since the configurations and dimensions of the lower hulls or struts have significant influences on the speed characteristics and navigation properties, it is required to establish a highly developed designing technique constructed while taking the respective properties and characteristics collectively into account.

SUMMARY OF THE INVENTION

It is a primary object of the present invention to provide a semi-submerged ship having the above-mentioned structure in which the characteristics of the conventional semi-submerged ship are fully utilized and the involved problems are effectively solved, that is, a semi-submerged ship in which the oscillations of the ship by waves at the time of stopping can be reduced without reduction of the navigation characteristics and the stability of the ship can be highly improved.

Another object of the present invention is to provide a semi-submerged ship in which the natural period of motion of the ship motion can be continuously changed according to the frequency of waves and the stability of the ship against waves on the sea can be highly improved.

Other objects of the present invention will be apparent from the following detailed description.

In accordance with the present invention, these objects can be attained by a semi-submerged ship comprising at least two lower hulls always located below the surface of water and arranged substantially in parallel to each other with respect to the direction of advance, struts mounted substantially vertically on the upper portion of each of all or at least two of lower hulls along almost the entire length thereof and an upper hull supported by said struts and always located above the surface of water, the draft line being located on the strut portion, wherein each strut is not divided in the lengthwise direction of the lower hull and at least one opening is formed on each strut so that watertight sealing is kept between the opening and the interior of the strut, and wherein the draft line is located on the openings of the struts while the ship is stopped.

More specifically, the semi-submerged ship of the present invention, the draft line area is changed at the time of stopping from the draft line area during navigation by utilizing the openings formed on the respective struts or by disposing flow-out and flow-in control means on the openings formed on the respective struts.

In a first embodiment of the semi-submerged ship of the present invention having the above-mentioned structure, at least one opening is formed on each strut above the draft line during ordinary navigation, and when the ship is stopped, the ship is submerged to such an extent that the draft line crosses the opening of the strut, whereby the natural period of the ship at the stopping is changed to prevent the natural period of the ship being synchronous with the frequency of waves and improve the stability characteristic of the ship.

In a second embodiment of the semi-submerged ship of the present invention, the opening of each strut is formed to have such a shape that the width of the opening is gradually increased from the lower portion toward the upper portion, for example, a reverse triangular shape or reverse trapezoidal shape, whereby the waterplane area of the strut is continuously changed within a certain range to continuously change the natural period of the ship.

In a third embodiment of the semi-submerged ship of the present invention, at least one opening is formed on the upper portion of each strut including the draft line during ordinary navigation, and a movable door is mounted on this opening so that the water-line area of the strut is reduced at the time of stopping by opening this movable door.

In a fourth embodiment of the semi-submerged ship of the present invention, at least one opening is formed on the upper portion of each strut including the draft line during ordinary navigation and a device for controlling flow-out and flow-in of water such as sea water is mounted on this opening, whereby the damping action is generated and the natural period of the ship is changed by the stabilizing effect of this control device to prevent the natural period of the ship from being synchronous with the frequency of waves. For example, a movable door or perforated plate is used as this control device.

According to the present invention, at least one opening is formed on the upper portion of each strut so that the draft line of the ship at the time of stopping crosses this opening. Therefore, the waterplane area of the strut can be reduced by the quantity corresponding to this opening. Furthermore, since a device for controlling flow-out and flow-in of water is disposed on this opening, the natural period of the ship at the stopping is prevented from being synchronous with the frequency of waves and as a result, the stability characteristic of the semi-submerged ship at the stopping can be improved without substantial reduction of the navigation characteristics.

Moreover, if the opening is formed to have a reverse triangular shape or the like, the water-line area can optionally be determined.

Still further, sine a movable door is formed on the opening of the strut and during the stopping this movable door is opened to allow sea water to flow through this opening, the waterplane area can be reduced by the quantity corresponding to this movable door and the natural period of the ship can be prolonged and be prevented from being synchronous with the frequency of waves, with a result that the motions such as oscillation of the ship at the stopping by the action of waves can be moderated or eliminated. In this case, since the movable door is shut during navigation, a cause of increase of the navigation resistance and reduction of the propelling power is eliminated even if the above-mentioned opening is formed. Therefore, the inherent propelling power of the ship can be sufficiently exerted.

Furthermore, in the semi-submerged ship of the present invention, a stabilizing effect can be attained by the device for controlling flow-out and flow-in of sea water or the like and the natural period of the ship can be appropriately changed.

As will be apparent from the foregoing description, in the present invention, both the navigation characteristic and the stability characteristic can be considered quite separately and independently from each other, and therefore, even if only the navigation characteristic is taken into account and the shape of the strut is arranged so as to attain a highest navigation characteristic, a good stability characteristic can be maintained while the ship is stopped.

The present invention will now be described in detail with reference to embodiments illustrated in the accompanying drawings, that by no means limit the scope of the invention.

BRIEF DESCRIPTION OF THE DRAWINGS

FIGS. 5(A) and 5(B) are views showing the sections taken along the lines VA—VA and VB—VB in FIG. 4, respectively;

FIG. 7 is a side view showing still another embodiment of the semi-submerged ship according to the present invention;

DETAILED DESCRIPTION OF THE PREFERRED EMBODIMENTS

Figure 1:
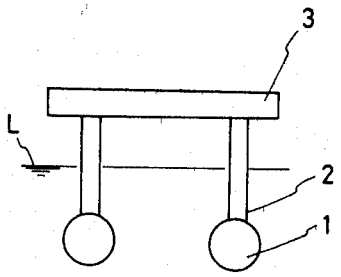
Fig. 1 PRIOR ART
FIGS. 1 and 2 are front and side views illustrating a conventional semi-submerged catamaran.
Figure 2:
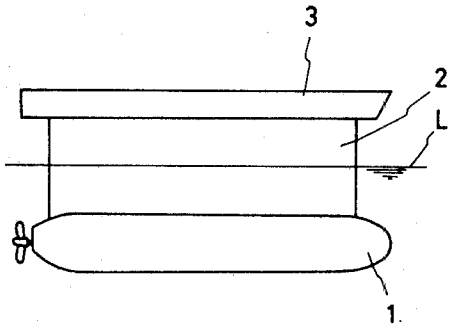
Fig. 2 PRIOR ART
Figure 3:
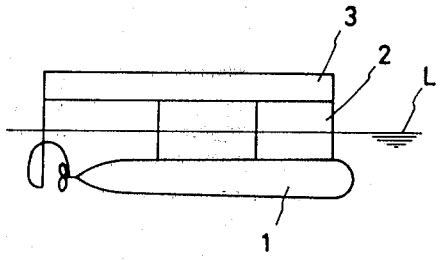
Fig. 3 PRIOR ART
FIG. 3 is a side view illustrating another conventional semi-submerged ship.

One embodiment of the semi-submerged ship according to the present invention will now be described with reference to FIGS. 4, 5(A) and 5(B).

A semi-submerged ship E shown in these Figs. comprises a lower hull 11 always located below an ordinary draft line L, struts 12 attached to the lower hull 11 and an upper hull 13 always located below the surface of water. The upper hull 13 is connected and fixed to the lower hull 11 through the struts 12.

The strut 12 extends along the substantially entire length of the lower hull 11, and it has a hollow structure and is not divided in the lengthwise direction of the lower hull 11. As shown in FIGS. 5(A) and 5(B), the section of the strut 12 in the lengthwise direction is rounded at each end edge so that each end edge has a stream-lined shape.

In the upper portion of the strut 12 above the ordinary draft line L, at least one opening 14 is formed.

This opening 14 is arranged so that water-tight sealing is kept between this opening 14 and the hollow interior of the strut 12. In the embodiment shown in the drawings, three openings 14 are arranged in the lengthwise direction of the strut 12 so that the lower edge 14*a* of each opening 14 formed on the upper portion of the strut 12 is located above the oridinary navigation draft line L of the semi-submerged ship E.

Accordingly, during navigation of the semi-submerged ship E, the opening 14 are located above the draft line and the navigation capacity is maintained. When the semi-submerged ship E is stopped, the ship E is sunk to raise up the position of the draft line of the ship E. That is, this new draft line L' is located at the position crossing the opening 14. Accordingly, the waterplane area of the strut 12 at the time of stopping is smaller by the quantity corresponding to the opening 14 than the waterplane area of the strut 12 during navigation. In this manner, the natural period of the motion of the ship is changed.

Lifting or lowering of the semi-submerged ship E is accomplished by an optional draft-adjusting device 15 mounted on the lower hull 11. A ballast tank is preferred as this draft-adjusting device 15.

In the present embodiment, the opening 14 is formed to have a rectangular shape, but other shapes are optionally adopted. When a shape shown in FIGS. 6(A) and 6(B) are used, the waterplane area of the strut 12 can be continuously changed within a predetermined range according to the position of the draft line crossing the opening 14, and therefore, the natural period of the ship can be continuously changed within a corresponding range, whereby the waterplane area can be delicately adjusted according to the frequency of waves on the sea so that an optimum stability characteristic can be obtained.

Figure 4:
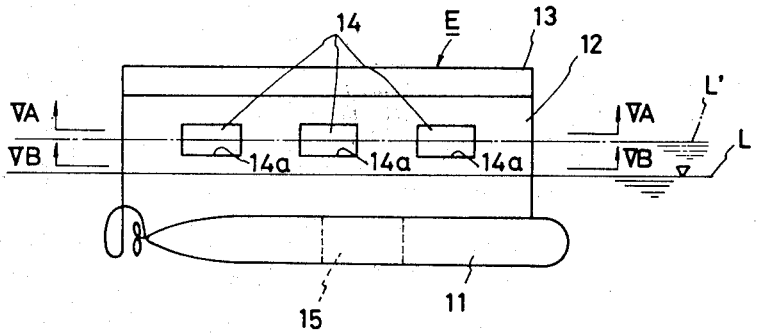
FIG. 4 is a side view illustrating one embodiment of the semi-submerged ship according to the present invention.
Figure 6:
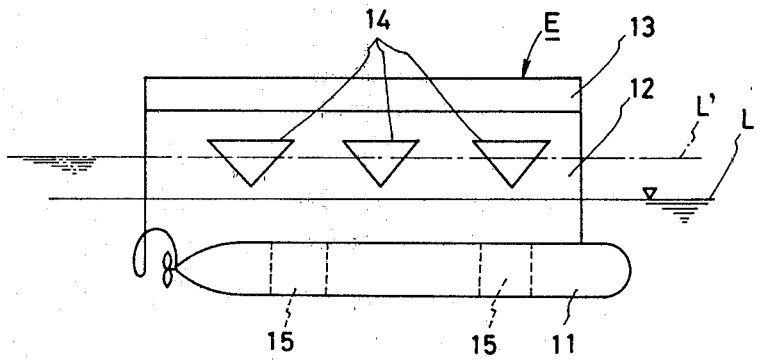
FIG. 6(A) is a side view showing another embodiment of the semi-submerged ship according to the present invention.
FIG. 6(B) is a side view showing a further embodiment of the semi-submerged ship according to the present invention.

Other parts of the semi-submerged ship E shown in FIGS. 6(A) and 6(B) are the same as those illustrated in FIGS. 4, 5(A) and 5(B).

Figure 8:
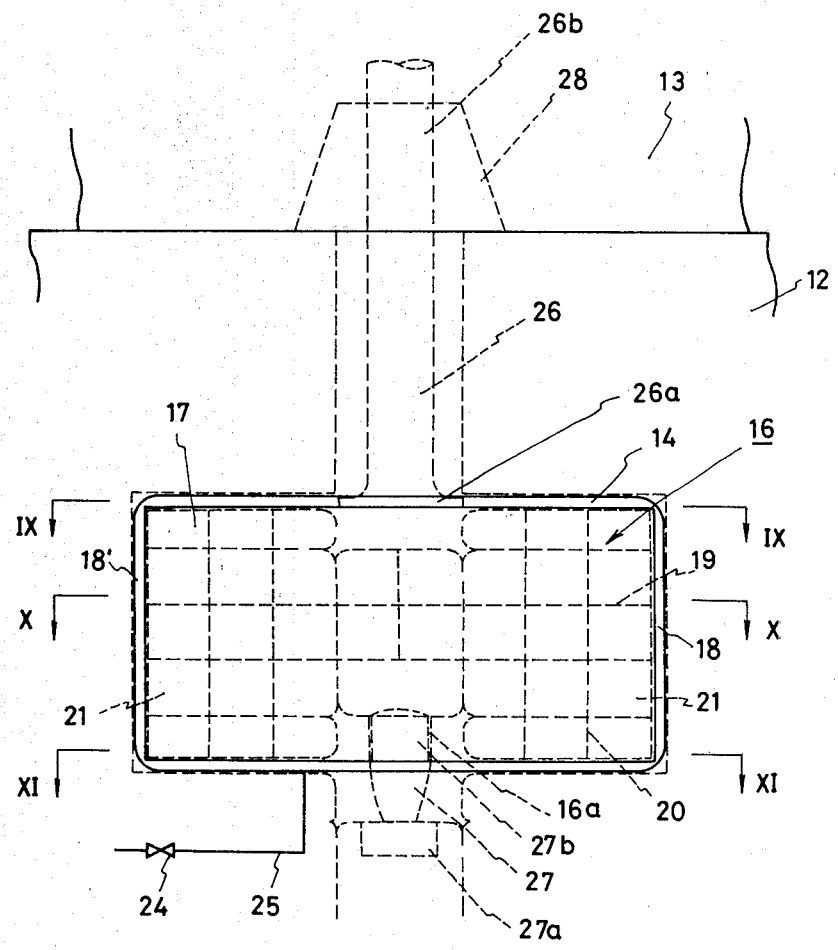
FIG. 8 is an enlarged side view showing the main part of the semi-submerged ship shown in FIG. 7.
Figure 9:
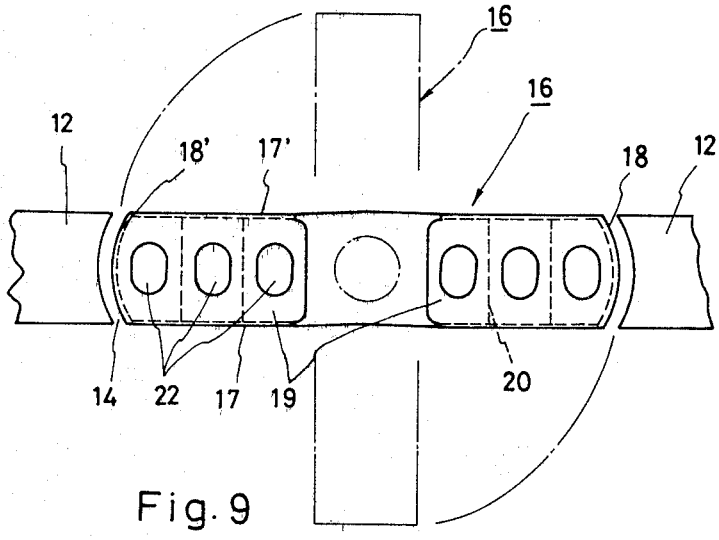
FIGS. 9, 10, 11 and 12 are views showing the sections taken along the lines IX—IX, X—X, XI—XI and XII—XII in FIG. 8, respectively.
Figure 10:
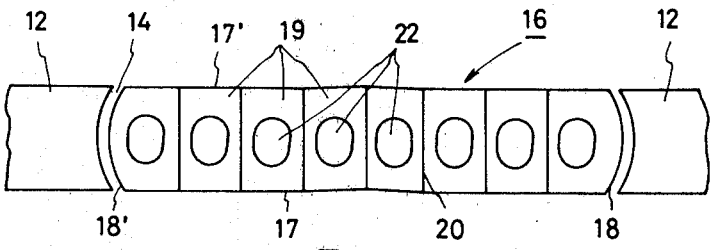
Figure 11:
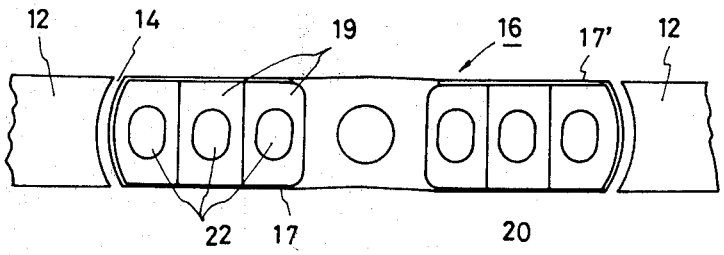
Figure 12:
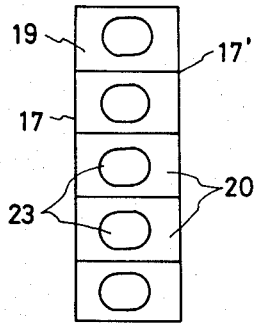

Another embodiment of the semi-submerged ship according to the present invention will now be described with reference to FIG. 7. FIG. 8 is an enlarged side view showing the main parts of the semi-submerged ship shown in FIG. 7 and FIGS. 9 to 12 are views showing the sections of examples of the structure shown in FIG. 8.

The semi-submerged ship E comprise a lower hull 11, a strut 12 and an upper hull 13. In this embodiment, two openings 14 are formed in the portion of the strut 12 including the draft line L, and a movable door 16 that can be freely opened and shut is formed on each opening 14.

As shown in FIGS. 8 to 12, the movable door 16 comprises a frame member including lateral side walls 17 and 17' and front and rear side walls 18 and 18', and a lattice member including a horizontal framework 19 and a vertical framework 20 is arranged in the frame member, whereby a number of small sections 21 are formed. These small sections 21 are communicated with one another through holes 22 formed on the horizontal framework 19 and holes 23 formed on the vertical framework 20. An optional sealing member (not shown) such as a packing is mounted on the peripheral edge of each opening.

The movable door 16 is connected to a water discharge line 25 having a valve 24 disposed in the midway, and this line 25 is connected to a discharge device (not shown) such as a pump.

The movable door 16 can be opened or shut by turning the movable door 16 with a stock 26 and pintle 27 mounted above and below the door 16, respectively, being as the center.

A base 26*a* of the stock 26 is fixed to the top end of the central portion of the movable door 16, and a top end 26*b* of the stock 26 is connected to a hydraulic device 28 attached to the upper hull 13, and this hydraulic device 28 is driven to turn the movable door 16 in the opening 14 and open or shut the movable door 16.

A base 27*a* of the pintle 27 is located at the center of the lower edge of the opening 14 to attach the pintle 27 to the strut 12 and a top end 27*b* of the pintle 27 is rotatably fitted in a recess 16*a* formed in the bottom of the central portion of the movable door 16, whereby opening or shutting of the movable door 16 by driving of the hydraulic device 28 can be performed smoothly.

During navigation, the movable door 16 is stored in the opening 14, and while the ship is stopped, the movable door 16 is turned by 90° or a larger angle by the hydraulic device 28 and fixed in this state.

When the movable door 16 is thus turned, the opening 14 of the strut 12 is opened so that sea water and air are allowed to move easily through holes 22 and 23 formed on the door 16, and sea water flows in the respective small sections 21 and the draft line is changed to the position L'. As a result, the waterplane area of the strut 12, that is, the sectional area in the draft portion, is reduced by the quantity corresponding substantially to the area of the movable door 16, and the natural period of motion of the semi-submerged ship E can be changed.

Figure 13:
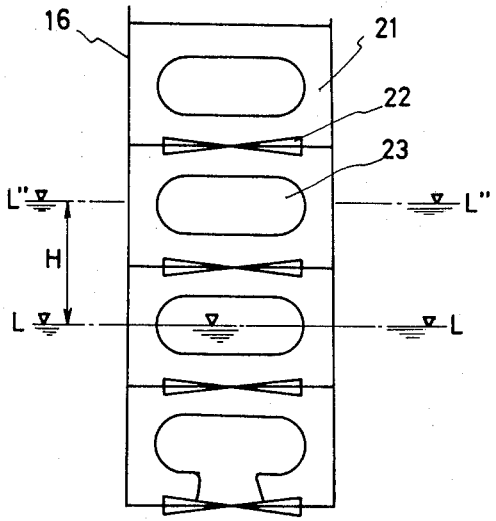
FIG. 13 is a diagram illustrating the operations in the semi-submerged ship according to the present invention.
Figure 28:
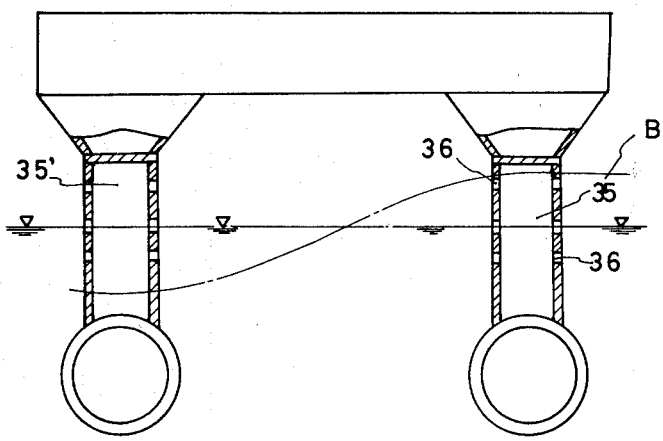
FIG. 28 is a diagram illustrating the relation between the semi-submerged ship and the waves.

In sea water that has flowed in the respective small sections 21, when the draft line is located at the position L and the surface of water is changed to the position L" as shown in FIG. 13 by the action of waves, there is brought about a head difference H. At this point, sea water is going to intrude into the interior through the movable door 16, but because of the throttling effect of the holes 22 and 23, a certain time delay is caused in flowing of sea water. As a result, a stabilizing effect is produced and the motion of the ship can be further controlled. This stabilizing effect is further enhanced when waves act on the strut 12 as shown in FIG. 28.

In the present embodiment, when the movable door 16 is shut for navigation and sea water in the movable door 16 is discharged through the discharge line 25, the draft line is returned to the position L from the position L' and the predetermined navigation capacity can be maintained.

In the present embodiment, even if the discharge line 25 and the sealing member are omitted, the intended stabilizing effect can be produced and the objects of the present invention can be similarly attained.

Figure 14:
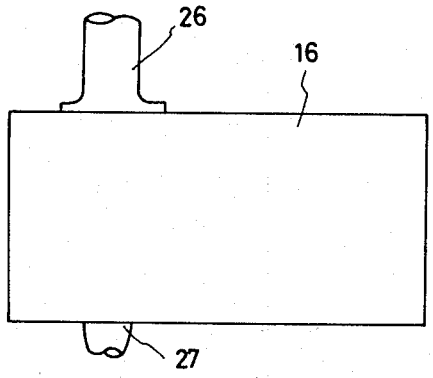
FIGS. 14 and 15 are diagrams illustrating examples of the movable door in the semi-submerged ship according to the present invention.
Figure 15:
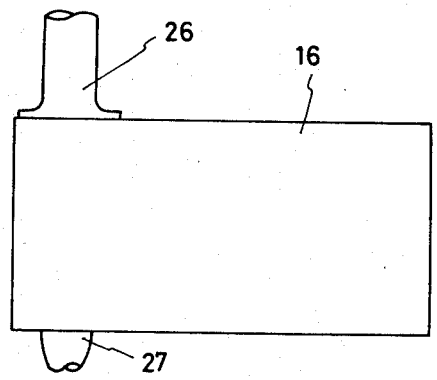

In the embodiment shown in FIG. 7, the rotation axis for opening and shutting the movable door 16 is disposed in the central portion. In the present invention, however, there may be adopted an embodiment in which the rotation axis is shifted slightly forwardly or backwardly from the central portion as shown in FIG. 14 and an embodiment in which the rotation axis is located in an extreme end portion as shown in FIG. 15. In each embodiment, an equivalent effect can be attained.

When an opening is formed at the position including the draft line and a door having a number of holes piercing at least in the vertical direction is formed on this opening so that the door can be freely opened and shut, the waterplane area of the strut can be changed and the damping action can be caused by opening this door when the ship is stopped, whereby the natural period of the ship can be changed and prevented from being synchronous with the frequency of waves and the stability characteristic of the semi-submerged ship at the time of stopping can be improved without substantial reduction of the naviation characteristic.

Figure 16:
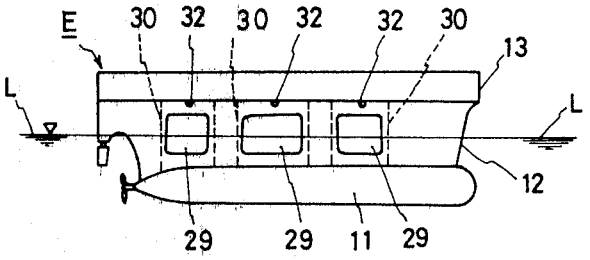
FIG. 16 is a side view illustrating still another embodiment of the semi-submerged ship according to the present invention.

Still another embodiment of the semi-submerged ship according to the present invention will now be described with reference to FIG. 16.

The basic structure of the semi-submerged ship of the present embodiment is the same as in the foregoing embodiments. This embodiment is different from the foregoing embodiments in the point that a device for controlling flow-out and flow-in of sea water is mounted in the opening 14.

Figure 17:
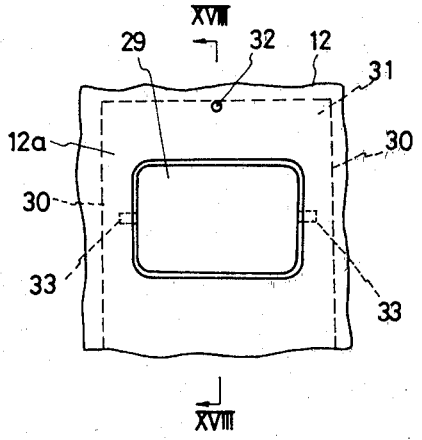
FIG. 17 is an enlarged side view showing the main part of a first example of the embodiment shown in FIG. 16.
Figure 18:
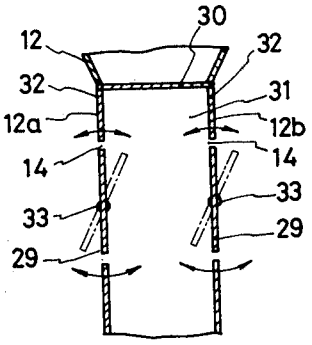
FIG. 18 is a view showing the section taken along the line XVIII—XVIII in FIG. 17.

A movable door 29 is mounted as the control device on the opening 14 of the strut 12. More specifically, a chamber 31 (opening) is defined by side walls **12*a* and 12*b* and partition wall 30 constructing the strut 12, and as shown in FIGS. 17 and 18, openings 14, movable doors 29 and air-escape holes 32 are formed on the side walls 12*a* and 12*b*. The interior of the strut 12 other than the chamber 31 including the opening 14** is kept watertight.

In the embodiment shown in FIGS. 17 and 18, the movable door 29 is fitted in the opening 14 so that it can be turned as indicated by an arrow by a supporting shaft 33 mounted horizontally in the opening 14.

Figure 19:
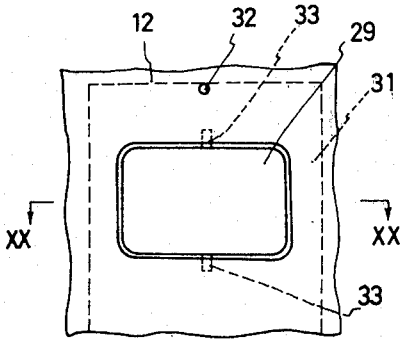
FIG. 19 is an enlarged side view showing the main part of a second example of the embodiment shown in FIG. 16.
Figure 20:
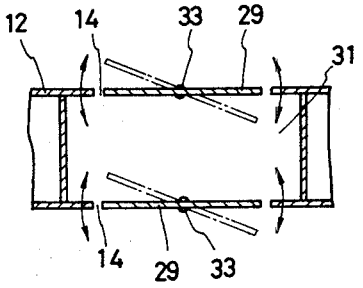
FIG. 20 is a view showing the section taken along the line XX—XX in FIG. 19.

In the embodiment shown in FIGS. 19 and 20, the movable door is disposed so that it can be turned as indicated by an arrow by a vertically arranged supporting shaft 33.

Figure 21:
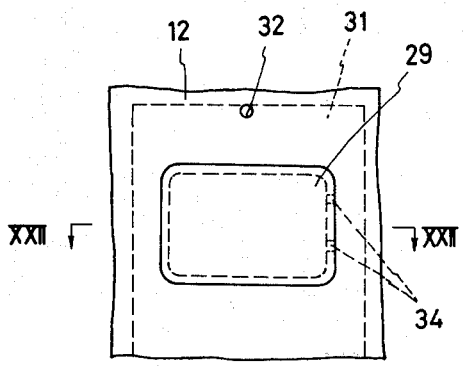
FIG. 21 is an enlarged side view showing the main part of a third example of the embodiment shown in FIG. 16.
Figure 22:
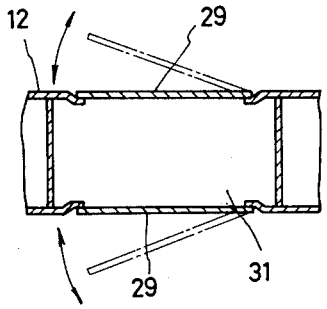
FIG. 22 is a view showing the section taken along the line XXII—XXII in FIG. 21.

In the embodiment shown in FIGS. 21 and 22, the movable door 29 is attached so that it can be opened and shut as indicated by an arrow by a hinge 34 mounted on the bow side. This hinge 34 may be mounted at an optional position, for example, on the stern side or on the upper or lower side.

Figure 23:
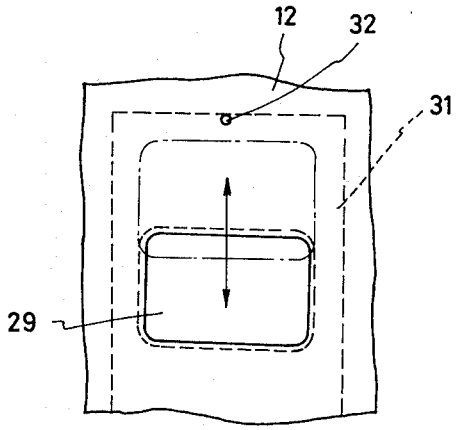
FIG. 23 is an enlarged side view showing the main part of a fourth example of the embodiment shown in FIG. 16.
Figure 24:
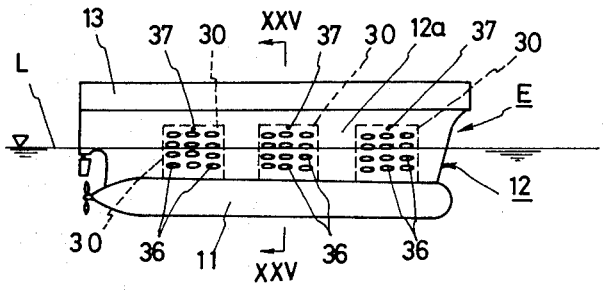
FIG. 24 is a side view illustrating still another embodiment of the semi-submerged ship according to the present invention.

In the embodiment shown in FIG. 23, the movable door 29 is mounted so that it can slide in the opening 14 in the vertical direction. Of course, the movable door 29 may be arranged so that it can slide in the horizontal direction.

In these embodiments, at the time of stopping the ship, the quantity of sea water flowing in the chamber 31 is controlled by adjusting the degree of opening in the movable door 29, whereby the damping action can be produced.

Still another embodiment of the semi-submerged ship according to the present invention will now be described with reference to FIGS. 25(A), 25(B) and 25(C).

Also the semi-submerged ship of this embodiment comprises basically a lower hull 11, an upper hull 13 and a strut 12 interposed between the upper and lower hulls.

A chamber 35 (opening) is defined by side walls **12*a* and 12*b* and partition wall 30 constructing the strut 12. A number of small holes 36 are formed on at least one of the vertical side walls 12*a* and 12*b* of the strut 12 including the oridinary draft line L and defining the chamber 35 (one side wall in the embodiment shown in FIG. 25(A) and both the side walls in the embodiment shown in FIG. 25(B)). More specifically, these small holes 36** are formed on the side wall to construct a perforated plate acting as the device for controlling flow-out and flow-in of sea water.

These small holes 36 are arranged so that the propelling capacity of the semi-submerged ship E during navigation is not reduced at all. More specifically, the size, shape, position and spacing with respect to the lengthwise direction are appropriately set for these small holes 36. Air-escape holes 37 may be formed in the upper portion of the chamber 35 according to need.

Figure 25:
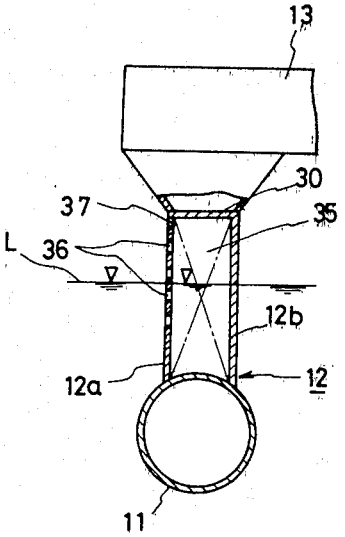
FIG. 25(A) is a view showing the section taken along the line XXV—XXV in FIG. 24.
FIGS. 25(B) and 25(C) are views showing the sections taken along the same line as in FIG. 25(A) in another examples of the embodiment shown in FIG. 24.
Figure 25:
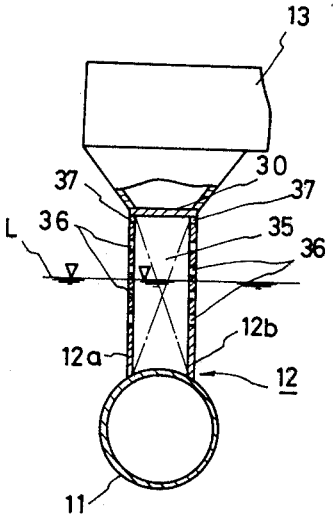
Figure 25:
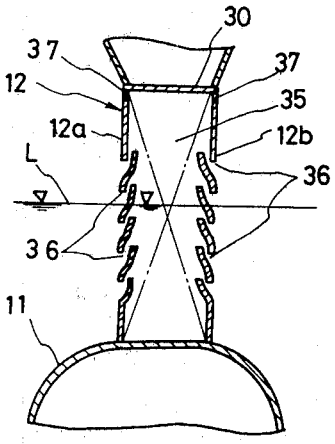

In the embodiment shown in FIG. 25(C), these small holes 36 are formed on the side walls **12*a* and 12*b* so that these holes 36 extend in a direction inclined to the side walls 12*a* and 12*b***. More specifically, these small holes are inclined downwardly from the inside in the upper portion toward the outside in the lower portion.

When the small holes 36 are downwardly inclined as shown in FIG. 25(C), sea water is allowed to flow in and from the chamber 35 according to the vertical motion of the ship, that is, the change of the draft line. Accordingly, during navigation, sea water is allowed to freely flow in and from the chamber 35 according to the change of the draft line and reduction of the propelling power during navigation can be effectively prevented.

Figure 26:
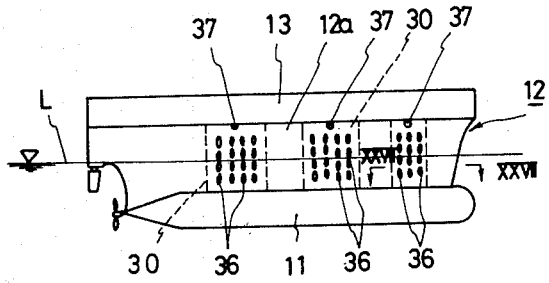
FIG. 26 is a side view illustrating a further embodiment of the semi-submerged ship according to the present invention.
Figure 27:
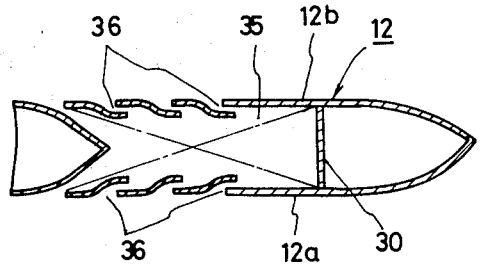
FIG. 27 is a view showing the section taken along the line XXVII—XXVII in FIG. 26.

When the small holes 36 are backwardly inclined from the inside to the outside of the chamber 35 as shown in FIGS. 26 and 27, sea water is allowed to freely flow in and from the chamber 35 according to the speed of the ship or increase or reduction of the speed of the ship during navigation. Therefore, the effect of preventing reduction of the propelling power of the ship can be enhanced by provision of these small holes 36.

The manners of inclination of small holes shown in the foregoing two embodiments may be combined. For example, small walls 36 may be inclined at an appropriate angle from the inside to the outside of the chamber 35 and from the front side (bow side) in the upper portion to the rear side (stern side) in the lower portion. In this embodiment, flow-out and flow-in of sea water in the chamber 35 in both the vertical direction and the advance direction can be effectively controlled in a composite manner.

While the ship is stopped, flow-out and flow-in of sea water in the chamber 35 can be controlled by these small holes, and a stabilizing effect owing to the phase delay of waves can be obtained and the motion of the ship can be moderated.

When waves B are present in the gunwale direction of the ship as shown in FIG. 28, an especially good effect is attained. In this case, sea water in the crest portion of the wave flows into the chamber 35 through small holes 36 but sea water in the trough portion of the wave flows out from the chamber 35'. Accordingly, in this case, the stabilizing effect is enhanced to further prolong the natural period of the ship and prevent the natural period of the ship from being synchronous with the frequency of waves, with a result that the rolling motion (lateral motion) of the ship at the stopping can be effectively prevented. The damping action causing this stabilizing effect is generated also in the longitudinal direction of the ship. Therefore, the pitching motion (longitudinal motion) of the ship can be controlled. Thus, in this case, while the ship is stopped, the motion of the ship caused by waves acting in all the directions with respect to the ship can be controlled and moderated.

The semi-submerged ship of the present invention may be applied to a passenger ship, a cargo ship, a factory ship or the like while appropriately arranging the structure of the upper hull. The semi-submerged ship of the present invention can be used for not only the marine transportation of passengers, cargos and other materials but also the ocean development as a factory ship or an oil drilling rig.

The semi-submerged ship of the present invention may be a catamaran having two lower hulls as shown in FIG. 28, or it may comprise three or more lower hulls. The number of the struts may be the same as the number of the lower hulls or may be smaller than the number of the lower hulls when three or more lower hulls are arranged.

In the present invention, it is preferred that at least the bow side end of each strut is rounded to have a stream-lined shape.

What I claim is:

1. A semi-submerged ship comprising at least two lower hulls always positioned below the surface of water and arranged substantially in parallel to each other with respect to the direction of advance, struts mounted substantially vertically on the upper portion of each of the at least two of lower hulls along substantially the entire length thereof and an upper hull supported by said struts and always positioned above the surface of water, wherein each strut is continuous in the lengthwise direction of the lower hull and at least one opening is formed on each strut wherein the height of said opening is less than the height of said strut and a water-tight seal is formed between the opening and the interior of the strut, and wherein the draft line is positioned on the openings of the struts while the ship is stopped.

2. A semi-submerged ship comprising at least two lower hulls always positioned below the surface of water and arranged substantially in parallel to each other with respect to the direction of advance, struts mounted substantially vertically on the upper portion of each of the at least two of lower hulls along substantially the entire length thereof and an upper hull supported by said struts and always positioned above the surface of water, wherein each strut is continuous in the lengthwise direction of the lower hull and at least one opening is formed on each strut wherein the height of said opening is less than the height of said strut and a water-tight seal is formed between the opening and the interior of the strut, and wherein when the ship is stopped, the ship is sunk to such an extent that the draft line crosses the openings of the struts, whereby the natural period of the ship is changed.

3. A semi-submerged ship as set forth in claim 1 or 2 wherein each opening has a reverse triangular shape.

4. A semi-submerged ship as set forth in claim 1 or 2 wherein each opening has a reverse trapezoidal shape.

5. A semi-submerged ship as set forth in claim 1 or 2 wherein the lower hull comprises a ballast tank as means for adjusting the draft.

6. A semi-submerged ship comprising at least two lower hulls always positioned below the surface of water and arranged substantially in parallel to each other with respect to the direction of advance, struts mounted substantially vertically on the upper portion of each of the at least two of lower hulls along substantially the entire length thereof and an upper hull supported by said struts and always positioned above the surface of water, wherein each strut is continuous in the lengthwise direction of the lower hull and at least one opening is formed on each strut at a position including the ordinary navigation draft line, wherein the height of said opening is less than the height of said strut and a water-tight seal is formed between the opening and the interior of the strut, and wherein a movable door is mounted in each of the openings of the struts.

7. A semi-submerged ship as set forth in claim 6 wherein a great number of small sections communicated with one another are formed on said movable door so that when the movable door is opened, water is allowed to flow in the small sections, whereby the inherent motion frequency of the ship is changed.

8. A semi-submerged ship as set forth in claim 6 or 7 wherein a sealing member is arranged along the peripheral edge of each opening.

9. A semi-submerged ship as set forth in claim 6 or 7 wherein a water discharge line is laid out in each strut so as to discharge water present inside the movable door.

10. A semi-submerged ship comprising at least two lower hulls always positioned below the surface of water and arranged substantially in parallel to each other with respect to the direction of advance, struts mounted substantially vertically on the upper portion of each of the at least two of lower hulls along substantially the entire length thereof and an upper hull supported by the struts and positioned above the surface of water, wherein each strut is continuous in the lengthwise direction of the lower hull and at least one opening is formed on each strut at a position including the ordinary navigation draft line, wherein the height of said opening is less than the height of said strut and a watertight seal is formed between the opening and the interior of the strut, and wherein a means for controlling flow-out and flow-in of water is mounted in each of the openings of the struts.

11. A semi-submerged ship as set forth in claim 10 wherein the means for controlling flow-out and flow-in of water is a movable door.

12. A semi-submerged ship as set forth in claim 11 wherein the movable door is arranged so that it can be turned by a supporting shaft mounted in said opening.

13. A semi-submerged ship as set forth in claim 11 wherein the movable door is arranged so that it can be opened and shut by a hinge mounted in the opening.

14. A semi-submerged ship as set forth in claim 11 wherein the movable door is arranged so that it can be slidably opened and shut.

15. A semi-submerged ship as set forth in claim 10 wherein the device for controlling flow-out and flow-in of water is a perforated plate.

16. A semi-submerged ship as set forth in claim 15 wherein holes formed on the perforated plate are inclined downwardly from the inside toward the outside of the strut.

17. A semi-submerged ship as set forth in claim 15 wherein holes formed on said perforated plate are inclined from the front side toward the back side of the ship and from the inside toward the outside of the strut.

* * * * *